US005648838A

United States Patent [19]

Michlin et al.

[11] Patent Number: 5,648,838

[45] Date of Patent: Jul. 15, 1997

[54] METHOD AND APPARATUS FOR ELECTRICALLY CONNECTING A DEVELOPER ROLLER TO A BIAS SOURCE

[75] Inventors: Steven Bruce Michlin, 5310 Bentley Suite 105, West Bloomfield, Mich. 48322; Herbert J. Mader, Kansas City, Kans.

[73] Assignee: Steven Bruce Michlin

[21] Appl. No.: 333,128

[22] Filed: Nov. 1, 1994

[51] Int. Cl.[6] ..... G03G 15/04; G03G 15/08

[52] U.S. Cl. ..... 399/119; 361/212; 399/262; 399/284; 399/285

[58] Field of Search ..... 355/200, 210, 355/245, 259, 260; 361/212, 214

[56] References Cited

U.S. PATENT DOCUMENTS

| | | | |
|---|---|---|---|
| 836,576 | 11/1906 | Hardwicke . | |
| 1,208,238 | 12/1916 | Tooker et al. . | |
| 4,259,003 | 3/1981 | Mangal et al. | 361/212 X |
| 4,951,599 | 8/1990 | Damji | 355/200 X |
| 5,085,171 | 2/1992 | Aulick et al. | 355/259 X |
| 5,250,992 | 10/1993 | Tsuneeda et al. | 355/221 |
| 5,296,901 | 3/1994 | Davies | 355/260 |

*Primary Examiner*—Fred L. Braun

[57] ABSTRACT

An toner cartridge and bias contact which pertains to the recharging of the cartridge by the development of a new way of making this electrical connection between the developer roller and the printer contact, in a most unique and simple way. In the best embodiment, an annular contact rides in the bore of the developer roller, pushed up against a stop where the bore diameter decreases, and the annular contact is tightly placed to attain accuracy, solidity, maximum contact and position. Also, a spring type contact may be used to set the gap of the doctor blade, controlling the distance between the developer roller and doctor blade. Alternately, a similar contact is attached to the end-felt roller seals of the developer roller. Electrical resistance has been provided to vary this bias voltage when desired and may even be added to the contact in the form of a resistant coating. A static limiter device which is used in the developer section to control voltage particularly when the humidity is low to prevent streaking and thus increase the usable range of humidity of the imaging device. The static limiter is made of screen as well as foil with pointed teeth, either grounded or charged opposite the developer roller charge.

29 Claims, 9 Drawing Sheets

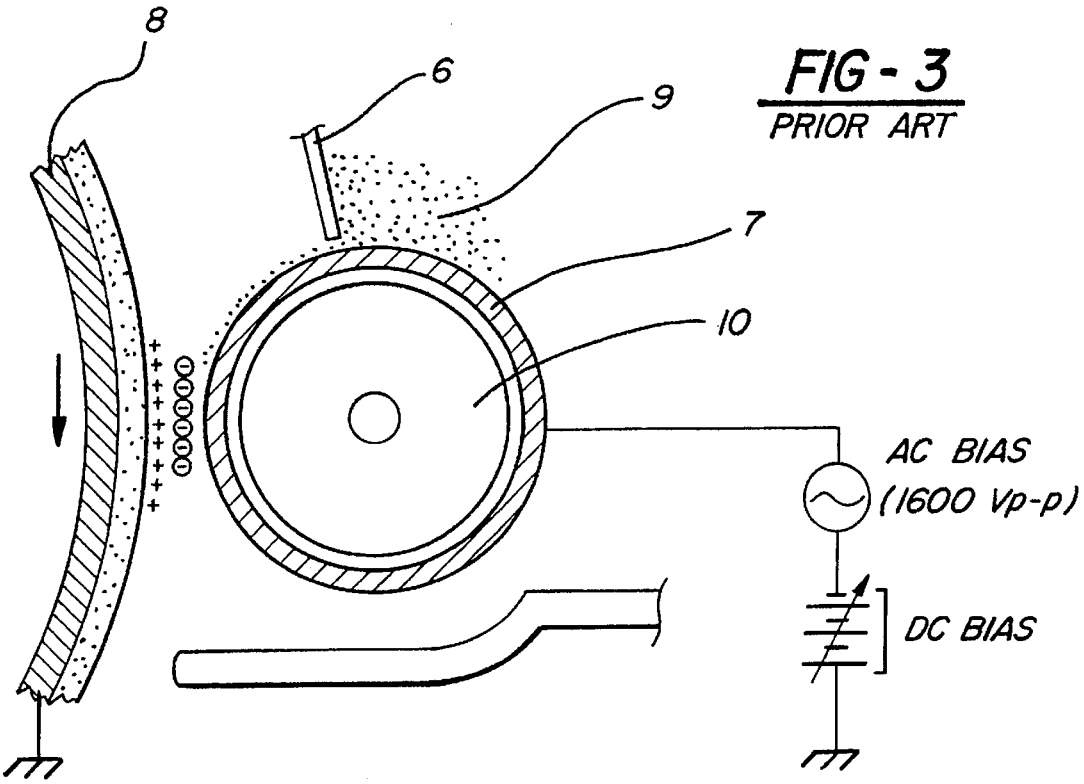
FIG - 3
PRIOR ART
FIG - 4
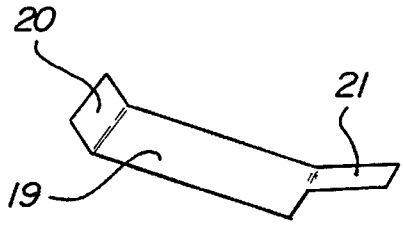
FIG - 5
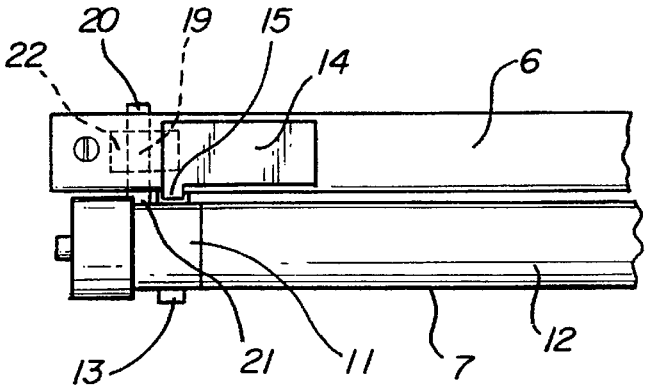

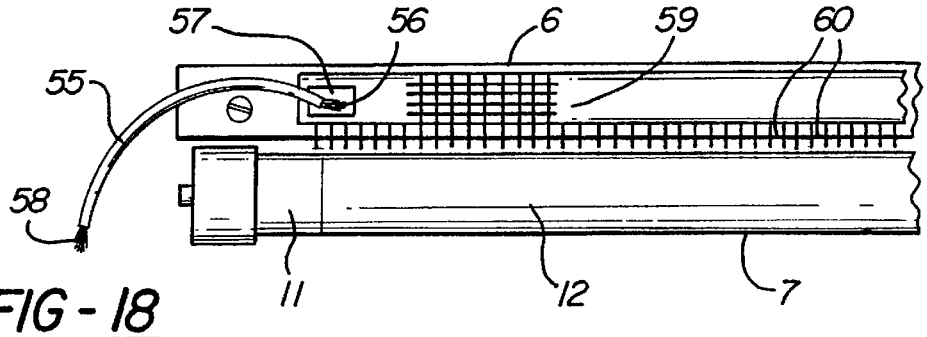
FIG - 18
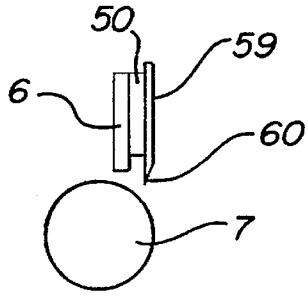
FIG - 19
FIG - 20
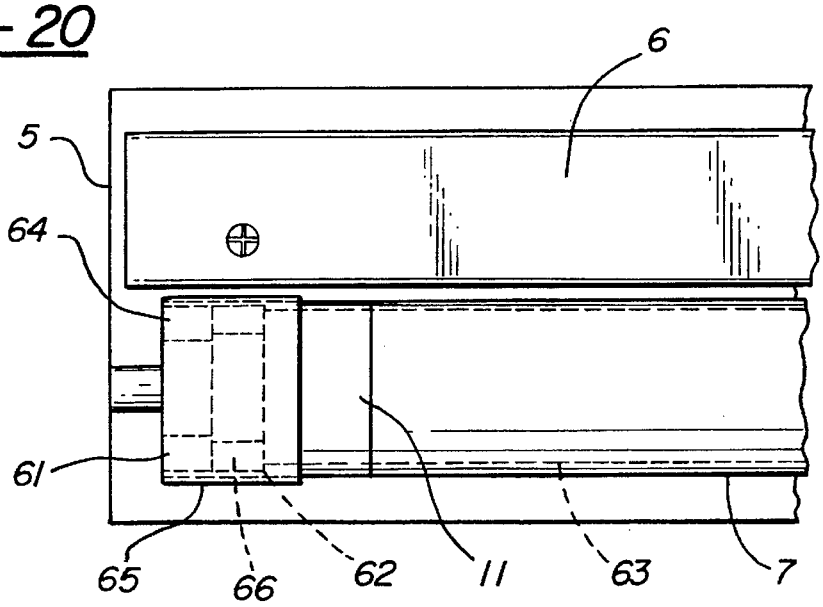
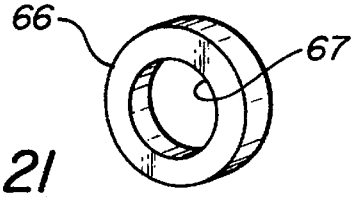
FIG - 21
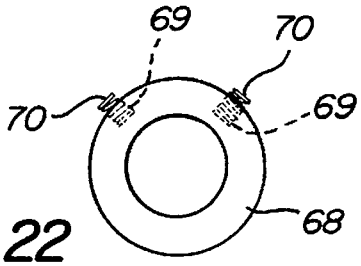
FIG - 22

METHOD AND APPARATUS FOR ELECTRICALLY CONNECTING A DEVELOPER ROLLER TO A BIAS SOURCE

BACKGROUND OF THE INVENTION

This invention relates to solving problems on developer rollers as used in Xerography and more specifically in the toner cartridge remanufacturing industry. This includes copiers, laser printers and facsimile machines.

CANON has designed an all-in-one cartridge as in U.S. Pat. No. 4,975,744, issued Dec. 4, 1990 and assigned to CANON. Several companies have used these cartridges in laser printers, copy machines and facsimile machines, each with the varying printer engines and a different nameplate. Originally, these cartridges were designed to be "disposable". However, after the first all-in-one toner cartridge was introduced, it did not take long before laser cartridge remanufacturers such as applicant began remanufacturing cartridges. These "disposable" cartridges were designed to function for only one cartridge cycle without remanufacturing. The remanufacturers had found certain components that needed replacement on a regular basis. In 1990, the first aftermarket photoreceptor drum became available for use in remanufacturing the all-in-one cartridge of the "SX" engine variety, the most popular printer cartridge from around 1987 through 1994 at the time of this writing. When the long-life photoreceptor drum became available, the entire remanufacturing industry turned around and gained great strength and began a huge growth surge that still continues. In October 1993, HEWLETT-PACKARD, the largest seller of this printer engine using the all-in-one cartridge, entered the cartridge remanufacturing industry with the "Optiva" cartridge, further increasing the size as well as credibility of this relatively new industry. However, this relatively new industry grew from the all-in-one cartridge shortly after its debut. Before the introduction of the long-life drum, sometimes called the "superdrum" or "duradrum", the SX cartridge would last for around three cartridge remanufacturing cycles at best, since the maximum useful life of the OEM drum was three cycles. However, the long-life drums got their names from the fact that they were designed to last for many remanufacturing cycles or recharges as they are sometimes called. Typically, the long life drum can last for ten or more such cycles, unlike the typical OEM (Original Equipment Manufacturer) drum. With the additional developments of drum coatings, originally designed for OEM drums, the long-life drum may last for many additional cycles. Some coatings, in theory, were designed to be dissolved and removed from over the drum surface every 1–3 cycles, so the drum life of the long-life drum almost seems limitless.

However, with photoreceptor drums lasting for many cycles, other components of the cartridge have a tendency to require greater durability, a better solution, or a greater life. Also, as the success of these cartridges has skyrocketed, the demand is for cartrides with longer cycles, so component improvements are significant. Therefore, avoiding natural problems with prevention means must also be implemented for cartridges of longer life both in longer cycle times and greater number of cycles. Developer rollers and related components are no exception. They do not last indefinitely although there are some things that may be done to increase the life expectancy.

First, the most often seen developer roller contact has been the OEM copper alloy helical spring to supply a bias voltage to the inside wall of the developer roller. Many developer rollers have a magnetic core. The rotating helical spring is in constant contact with a stationary stainless steel spring-loaded welded-washer subassembly, where the welded-washer is contiguous with the assembly where printer contact is made. As the developer roller rotates, the helical spring is always in contact with the stainless steel welded-washer subassembly. The welded-washer subassembly provides the helical spring with the bias voltage connection supplied by the printer's electronic circuitry which then supplies the bias voltage to the aluminum developer roller sleeve on the inner wall. However, on a random basis, more frequently than desired, this connection between the stainless steel washer and the helical spring loses its integrity. It wears. It loses its spring force. The spring may be bent back to its original "design" position, but, it is a fairly time consuming task to bend it back out and even more difficult to obtain the correct bend. The OEM helical spring connects to the inner wall of the developer roller aluminum sleeve by digging into the inner wall with 2–4 prongs that eventually loosen up and decrease the quality of the electrical connection. Both the spring and washer may obtain deposits of insulative toner, or oxidation from the spring copper of the helical spring. Even a speck of insulative debris is enough to ruin the integrity of this connection. Since it rotates, the connection must be thought of as a connection for 360 degrees of rotation. A little speck of discontinuity is all it takes to ruin what would have otherwise been a perfect image. Similarly, in a 360 degree rotation of the developer roller, a small amount of imperfection from out-of roundness may also cause a decrease in integrity of the connection between the helical spring and the welded-washer subassembly. With this system, there are many places where it can go wrong. For example, the location where the washer touches the source of the bias voltage. There is the connection where the helical spring rotates, touching the welded-washer subassembly. The helical spring is part of an assembly that fits inside the developer roller. The assembly "bites" into the inner wall (usually aluminum) of the developer roller. It may eventually lose good contact at that point. Typically, these developer roller contacts bite into the inner wall in two or three small places. It may lose its connection integrity from the spring losing its original resiliency. However, whatever the reason it loses its integrity, it does not function the same as brand new over many cycles. Furthermore, the replacement components are not available from the OEM manufacturer. Consequently, remanufacturers have had to come up with their own solutions to this problem. Many Americans livelihoods are at stake when you look at the size of the cartridge remanufacturing industry.

I introduced the first solution to the problem when I wrote an article over two years ago about using conductive grease in this assembly where the helical spring contacts the stainless steel washer (Recharger February 1992, pg 95, "Tech Talk and New Ideas"). Others soon copied this idea and used other conductive greases. In the Summer of 1993 the debate began about which conductive greases are appropriate. There are two schools of conductive greases, very generally. The first type function well in practice, but by themselves do not conduct current as measured with a voltmeter or ohmeter. However, although this produced "miracle" results with my customers, the effectiveness of the grease fell off near the end of the cartridge cycle when the grease was gone. Furthermore, to grease the helical spring area for every cartridge cycle is too labor intensive. After getting to the difficult to reach helical spring and stainless steel washer, reassembly of the developer roller is very time consuming. This was the first fix known for this problem.

Among the symptoms of not fixing this problem are uneven darkness on the output page, uneven blacks, uneven gray shades, and unsolid blacks. By using the conductive grease, the problem goes away. However, it is cumbersome to apply. I have been searching for a better way.

The other conductive grease, used by some, is a black conductive grease. This grease, when measured with an ohmeter, has continuity at any distance. However, unlike the other described grease which wears away near the end of the cycle, the black grease cakes up or hardens before the end of the cartridge cycle. In conclusion, conductive greases were a good fix before other solutions came about.

Applicant has invented a conductive grease that is a combination of the two schools of thought. By mixing the conductive grease that measures no conductivity with conductive carbon black and/or graphite, a conductive grease has been developed that has properties of each type and is conductive when measured with an ohmeter. By using silicon grease, a nonconductive, insulating grease used in automotive and aircraft industry, used as an insulative material around battery terminals, ignition systems, and spark-plug connections, to prevent corrosion, a material is made by DOW CORNING Corporation that meets the MIL-S-8660 specification and is essentially a moisture barrier. Any such insulative silicone grease, like the kind you see in an automotive store may be used as the main ingredient. By mixing the insulative grease with either/or conductive carbon black and/or conductive graphite, a highly conductive yet moisture-free conductive grease was developed for use where electrical connections are made and particularly electrical connections where there is mechanical motion. The conductive grease maintains the conductivity throughout at the contact points and is particularly useful in the imaging industry for charge roller contacts, drum axle contacts, and particularly developer roller bias contacts, as they will be discussed throughout this application.

A second improvement involves a spring inside the developer roller. In this development remanufacturers began by removing the helical spring assembly from inside the developer roller. They snipped off the helical portion, two helical prongs, from the helical spring assembly, placed the modified helical assembly back in the developer roller tube (no longer helical), and placed a coil spring between the assembly and the stainless welded-washer subassembly. I used a steel piano wire coil-spring in this place. One company used a copper alloy coil spring. Another company replaced the spring assembly with a copper alloy assembly to receive the coil spring and added to it a copper alloy washer to replace the stainless steel washer which may be used as an addition to it and the coil spring. However, this product was practical for large customers for only one main reason. It was found that reliability was low until the user used the product for a while. Then cartridge technicians began using assembly jigs to accurately place either the original modified helical assembly or its replacement assembly into the developer roller. Since precision is important, some remanufacturers find this kind of product desirable and others find it too time consuming. Many do not have the patience to learn to use it correctly. Even so, coil springs lose resilience with wear-time and this product, even when properly installed, has a limited life.

Another product that has come on the market is a clip for providing the bias voltage directly from the doctor blade to the developer roller, similar to the spring. The clip, similarly helps the bias voltage stay in contact with the developer roller sleeve, but on the outside wall of the developer roller sleeve, but it cuts a groove in the outer wall. The bias voltage is important for transporting toner from the developer roller to the photoreceptor drum. It is transported by two main forces. First, the photoreceptor drum has a charge on it for white space and a lack of or lesser charge where there is black image space. In other words, the charged surface of the photoreceptor drum repels toner while the uncharged pixels, where charge was removed by laser light, attract toner from the surface of the developer roller. The developer roller is continually ready to move toner to and from the photoreceptor drum in this selective fashion. However, the developer roller has a bias voltage that essentially in simplification repels and attracts toner to and from the photoreceptor drum. It is this bias voltage that is at the very core of the main problems that are solved in this invention. In simple terms, the bias voltage has an AC and DC component. The AC component essentially charges typically at 1600V AC and 1800 HZ while the DC component charges typically at −500 volts DC. The AC component at 1800 HZ essentially causes toner to jump on and off the developer roller sleeve, thus supplying a cloud of toner to the photoreceptor.

It is the continuity of the bias voltage that is the heart of the described prior art as well as an embodiment of this invention. For example, the conductive grease helped prevent the bias voltage discontinuity. The coil spring and kits, as well as the clip, did the same. However, a simpler, more effective bias voltage connector is needed.

The concept of static elimination/limitation is a known concept in electrostatics. For example, any sharp pointed metallic object that is either grounded or oppositely charged than an existing electrostatic charge or source of such a charge will diminish that charge. A static limiter device, however, consists of a set of many such pointed grounded or oppositely charged points. Some use sharp pointed metal and others use a metal object with a set of several evenly spaced wires protruding. This type of a device has been used in the SX printer, for example, in prior art, for charging the paper negatively (rather than grounding) to prevent thin paper from wrapping around the negatively charged photoreceptor drum at the transfer station where a positively charged transfer corona assembly charges. This is located in the printer, not in the toner cartridge. A device is needed to control the static electricity in the toner cartridge assembly adjacent the developer roller and drum to maintain the quality of the image. This device would increase the integrity of the bias voltage for better contact and, therefore, better image consistency and quality while allowing the printers, copiers and facsimile machines to operate under conditions that in current state-of-the-art it could not. With such a device the machines would be able to operate in a wider humidity range, at high altitudes, in the dry seasons when outdoor weather is very cold (although the machine is indoors) and in dry desert climates.

SUMMARY OF THE INVENTION

Accordingly, it is an object of this invention to provide a bias voltage connector between the doctor blade and developer roller of a toner cartridge assembly which is more versatile, cheaper and easier to manufacture.

It is another object of this invention to provide a bias voltage connector which is able to set the gap between the blade and roller.

A further object of this invention is to enable the bias voltage connector to modify the bias voltage through the use of selected or variable resistance.

A still further object of this invention is to reduce the static electricity in the area of the doctor blade and developer roller to maintain the quality of the image.

A further object of this invention is to provide a bias voltage connector as above for a better bias voltage connection to the developer roller while at the same time reducing static electricity in the area of the developer roller. By combining the two embodiments, the developer roller is both given a consistent bias connection and its bias voltage can not vary as much in effect in unusual environmental conditions such as humidity, air pressure, and altitude, thus increasing the operating range of the imaging machine.

Another object of this invention is to provide a bias voltage connector combined with a resilient developer roller endfelt seal. This may be done using metal or by adding a conductive liquid or grease or other conductive material onto the developer roller endfelt.

Still another object of this invention is to provide a bias voltage contact to the developer roller using a flat contact device which touches the inside wall of the developer roller to make electrical contact and presses against the welded-washer subassembly connected to the bias voltage contact component of the printer device.

In carrying out this invention in the illustrative embodiment thereof, a bias voltage connector made of a spring-tempered metal is secured within the cartridge assembly such that the connector contacts both the doctor blade and developer roller. The connector is bent and cut to conform to the contours of the blade and roller to ensure continous dependable contact. The connector may optionally have a specific thickness such that, when extended between the blade and roller, it can set the size of the gap between the two components. The connector may also be optionally provided with a selected or variable resistance so the bias voltage connector can modify the bias voltage to obtain a high quality image in various environments.

The invention includes a static limiter device formed from a length of metallic sheet or foil with pointed teeth cut into its edge. The device is attached to the doctor blade with its teeth immediately adjacent the roller. By grounding the static limiter device, for example, the device eliminates/limits or reduces the static electricity in the area of the blade and roller, preventing hazy or otherwise poor quality images. Thus, when the bias voltage as applied to the developer roller sleeve may in low humidity conditions or other unusual conditions during otherwise normal machine operation may create an excess of static electricity which interferes with other parts of the imaging system and must be controlled or limited to increase the operating range of imaging devices.

BRIEF DESCRIPTION OF THE DRAWINGS

This invention, together with other objects, features, aspects, and advantages thereof, will be more clearly understood from the following description, considered in conjunction with the accompanying drawings.

FIG. 3 is a broad illustration of how the image is developed.

FIG. 4 is an enlarged view of a first embodiment of the bias voltage connector of this invention.

FIG. 5 illustrates the manner in which the bias voltage connector is secured to the doctor blade.

FIG. 18 shows a second embodiment of the static limiter device.

FIG. 19 is an end or sideview of the second static limiter device.

FIG. 20 is an enlarged illustration of how a bias voltage contact device would be used inside the developer roller.

FIG. 21 shows a first embodiment (enlarged for clarity) of the internal contact device.

FIG. 22 shows a second embodiment enlarged) of the internal contact device.

COMPLETE DESCRIPTION OF THE PREFERRED EMBODIMENT

Figure 1:
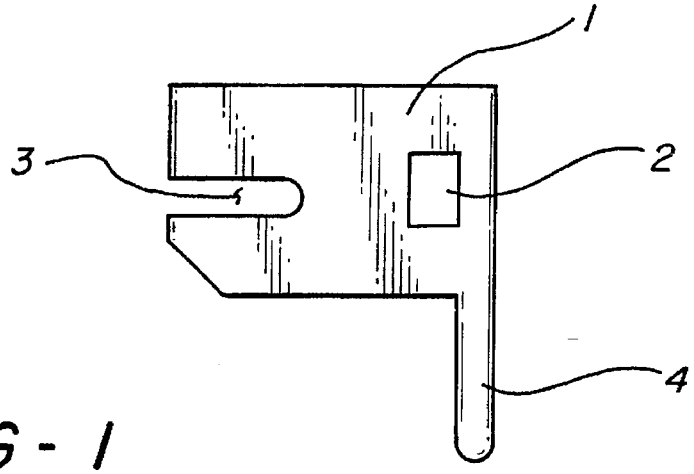
FIG - 1 PRIOR ART
FIG. 1 shows a prior art bias voltage clip.
Figure 2:
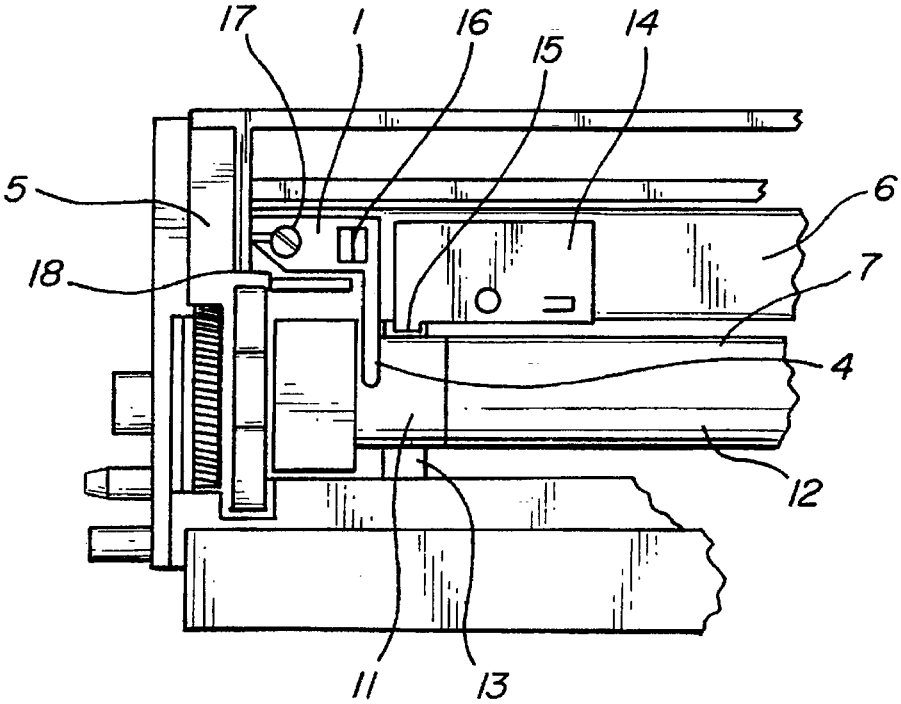
FIG - 2 PRIOR ART
FIG. 2 illustrates how the prior art clip is attached to the doctor blade such that it contacts the developer roller.

FIG. 1 shows a prior art aftermarket bias connector. The bias connector is in the form of a clip 1 with a square hole 2, slot 3 and thin contact prong 4. As shown in FIG. 2, the clip 1 becomes part of the toner cartridge assembly 5, of which only the relevant end is shown. The cartridge assembly 5 includes a doctor blade 6 and developer roller 7.

The toner is attracted from the developer roller 7 to the photoreceptor drum 8 as illustrated in FIG. 3. The toner 9 is composed of black plastic resin bound to iron particles. The developer roller 7 has a magnetic core 10 so the toner particles are attracted to it. As the roller 7 rotates with toner 9 on it, the doctor blade 6 controls the thickness of toner on the surface of the developer roller 7. The plastic toner particles receive a negative surface charge by rubbing against the developer roller because the roller 7 is connected to a DC supply. The electrostatic charge on the particles attracts the toner 9 particles to uncharged portions of the photoreceptor drum 8 that have removed charge from pixels of light. The charged areas of the photoreceptor drum repel the toner particles. An AC potential on the developer roller 7 helps move the toner 9 to the photoreceptor drum 8 at the desired uncharged areas yet helps toner come back to the developer roller 7 from charged areas of the drum 8 to improve density and contrast because the AC charge alternates.

The roller 7 has a nonprint region 11. In this nonprint region 11, the developer roller 7 is smoother than the toner transport section 12 of the roller 7. Toner is not allowed to adhere to the surface of the roller 7 in the nonprint region 11. Typically, a felt pad 13 forms a semicircle, partially around the roller 7 and seals off the end of the roller 7 to prevent toner leakage from the assembly 5. The smooth felt pad 13 keeps the nonprint region 11 of the roller 7 clean or free of toner and other debris. Also, in some models, a plastic member 14 attached to the doctor blade 6 has an extension 15 which scrapes toner from the area of the nonprint region 11 of the roller 7.

In typical toner cartridge assemblies like SX, the all-metal doctor blade is charged the same as the developer roller bias, and is on the same circuit, and similarly the frame of the NX doctor blade is charged. The clip 1 was designed to ensure continuity of the bias voltage provided to the developer roller 7 when the bias voltage supplied from the helical spring assembly within the roller 7 becomes ineffective through insulative toner deposits, insulative oxidation, age and wear. The square hole 2 in the clip 1 fits over the doctor blade aligner 16 on the assembly 5. The clip 1 is therefore easily guided into place on the doctor blade 6. The slot 3 is for allowing the clip 1 to be accurately screwed onto the blade 6 with the same screw 17 which secures the doctor blade 6 to the assembly 5. The thin contact prong 4 enables the clip 1 to contact the nonprint region 11 of the roller 7 between the scraping extension 15 of the plastic member 14 and an obstructing wall portion 18 of the assembly 5. Since the doctor blade is charged, the clip 1 provides dependable electrical contact between the blade 6 and developer roller 7. The continuity of the bias voltage is ensured.

It should be noted that the toner transport section 12 of the developer roller 7 cannot be an electrical contact point for two reasons. First, it has a rough surface, typically etched and sandblasted with glass beads or other special treatment such as a coating. Secondly, the section 12 has a continual layer of toner on it. This toner is ready to be transported to the photoreceptor drum. So it is important that the clip 1 contacts the nonprint region 11 of the roller 7 rather than in the print region. One problem that this clip has is that it the prong 4, always contacting the nonprint region 11 of the developer roller 7 can cut grooves in the roller 7, and thus decrease the roller's 7 usable life.

The bias voltage connector of this invention is designed to be a substantial improvement over the prior art clip 1. It saves in material costs, labor costs, material waste in manufacturing, manufacturing costs, setup manufacturing costs, die costs, and automation costs. The bias connectors of this invention also, through its great adaptability, performs other functions in increasing the quality of the print on the output pages.

FIG. 4 shows a first embodiment of the improved bias voltage connector 19. The connector 19 comprises a small piece of spring copper alloy or spring stainless steel or other metal contact. On one end of the connector 19 is a bent section 20. On the second end of the connector 19 is a bent section 21 cut or stamped narrower than the remainder of the connector 19. The bias voltage connector 19 is designed to fit under the doctor blade 6 in the SX cartridge as shown in FIG. 5. The bent sections 20 and 21 allow the connector 19 to fit the contour of the doctor blade 6. The narrower bent section 21 is sized to fit next to the scraping extension 15 (present in the SX hopper but not all hoppers) of the plastic member 14 and contact the nonprint region 11 of the developer roller 7, while still being supported and contacting against the back of the blade 6. The connector 19 may be taped against the blade 6 with a one-sided tape 22. Having the connector 19 bent to fit the blade 6 prevents the possibillity of the connector 19 shifting and moving out of place, and the tape 22 provides further assurance.

If it wasn't for the fact that the developer roller 7 rotates with respect to its contact, the electrical connection would not be difficult and this invention would not be necessary. The connector 19 completes the circuit between the charged blade 6 that receives the bias voltage and the roller 7. It ensures the continuity of the bias voltage supplied to the developer roller 7 for the printing function. It is beneficial to put a very small amount of conductive grease on the narrow bent section 21 of the connector 19 where it contacts the nonprint region 11 of the roller 7 to reduce wear of the connector and roller. The connector 19 does not need alignment holes for fixing it to the blade 6 and is simpler to manufacture than the clip 1.

Brass, bronze, stainless steel and other metals may be used for the connector 19. Spring tempered versions of these alloys would be best since there is a spring force on the contact device. CDA 510 phosphorus bronze and CDA 521 are typical examples of economical choices. A "spring" CDA 510 consists of approximately 95 percent copper and 5 percent tin. CDA 521 is also readily available with a spring temper. For even better properties, a beryllium copper alloy such as CDA 172, often used in telecommunications applications, may be used. However, CDA 172 costs around five times as much as CDA 510. For this reason, the increase in cost is not always worth the benefits. The reason for this product is to save in cost over other alternatives available. It saves in material costs, labor costs, material waste in manufacturing, manufacturing costs, setup manufacturing costs, die costs, and automation costs.

Generally, a bias voltage connector 19 with a thickness of two to four thousandths of an inch works well. However, thicker connectors may be used, depending on the application. But by selecting a certain thickness, the connector 19 may be used for an additional function. For example in the SX version, the most widely used cartridge at this writing, the doctor blade 6 is all metal and must be "gapped". Gapping is using a temporary shim to set the distance between the doctor blade and developer roller. By properly setting this distance, one controls how heavy the toner will print on the page. By gapping widely, the print may become bold in appearance. By gapping narrowly, the print may become light in appearance. However, the tradeoff is that the dark pretty print uses up toner at too fast a pace and the light print allows more mileage out of the toner in the cartridge. The gapping distance ranges from around four thousandths of an inch to about twenty-five thousandths of an inch. The gap distance I normally recommend is at ten thousandths of an inch. If the bias connector 19 was this thickness, it could be used simultaneously as a gapping tool shim and as a bias connector.

Figure 6:
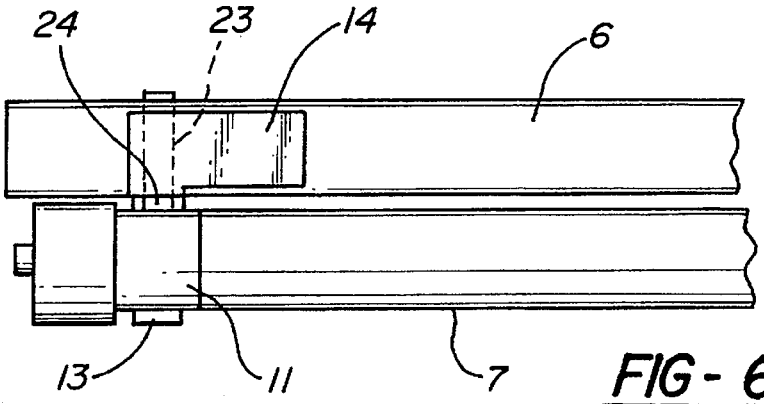
FIG. 6 shows how the bias voltage connector may be used to set the gapping distance and also replace the scraping extension.

FIG. 6 shows a slightly modified bias voltage connector 23 with a section 24 bent such that it would extend between the edge of the blade 6 and the roller 7, setting the gap or space between them while still contacting the nonprint region 11 of the developer roller 7. The bent section 24 could be made narrow enough to fit next to the scraping extension 15 of the plastic member 14, or the scraping extension 15 could be cut, filed or otherwise removed from the plastic member 14. In this case, the bent section 24 of the connector 23 would also perform the scraping function, keeping toner off the nonprint region 11 of the roller 7, and the connector 23 with bent section 24 could be made wide enough to ensure stable, secure connection to the blade 6.

Figure 7:
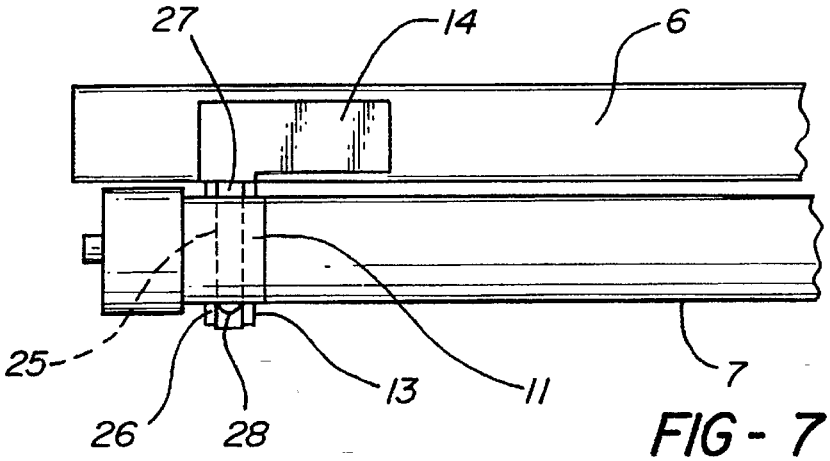
FIG. 7 demonstrates an alternative location for securement of the bias voltage connector.

As an alternative, the bias voltage connector could be glued, taped or otherwise adhered to the felt pad 13, as illustrated in FIG. 7, between the felt pad 13 and the nonprint region 11 of the developer roller 7. The felt pad acts as a seal at each end of the developer roller 7, sealing a semicircle of around one third of the way around the roller 7. If the bias voltage connector 25 was secured to the felt pad 13 by a foam-type two-sided tape 26, for example, the quality of the seal would be maintained. The end 27 of the connector 25 must contact the blade 6 to provide the electrical connection between the blade 6 and roller 7. The spring temper quality of the connector 25 ensures the connection. Again, conductive grease 28 applied on the connector 25 where it contacts the nonprint region 11 of the roller 7 helps prevent excessive wear.

As imaging technology develops for bigger, better, faster, longer lasting toner cartridges and printers, component by component, each component will be designed to last longer and for faster use. This is inevitable. It seemed impossible in 1985–86 that an individual could have a laser printer in their home. Not only is it now reality, but faster and longer lasting devices are used in small businesses as well as homes. It is therefore, inevitable, for these reasons, that each component must be improved for speed and longevity. Therefore, it is inevitable that more wear-resistant aluminums, stainless steel, and other hard materials will be used for developer roller sleeves. Then the device of this and some of the following embodiments will be more practical when technology advances to that level.

Figure 8:
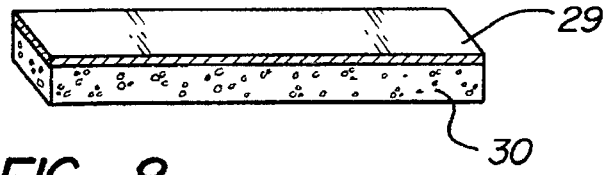
FIG. 8 shows a combination bias voltage connector and seal.
Figure 9:
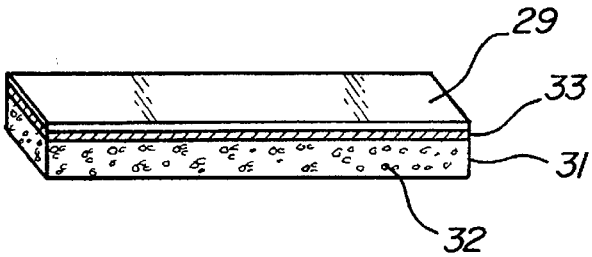
FIG. 9 is a modification of the FIG. 8 bias voltage connector-seal combination.

FIGS. 8 and 9 show alternatives to the bias voltage connector 25-felt pad 13 combination illustrated in FIG. 7. The bias voltage connector-seal of FIG. 8 consists of a bias contact metal strip 29 attached by adhesive to a piece of Foam 30 or foam tape. The foam 30 is a resilient material and gives the seal resiliency. Crush-resistant material may also be used. The combination of the metal strip 29 and foam 30 is extremely durable and practical, both as an electrical connection and seal.

There may be some cases where the developer roller can wear down somewhat from the metal to metal friction. However, as stated, this may be solved by using more wear-resistant developer rollers in the marketplace. Due to frictional heat, it is also advisable to use a heat-resistant foam 30 and heat resistant adhesive or otherwise to use a heat-resistant foam tape. In the FIG. 9 embodiment, the seal is a foam tape 31 comprising a piece of foam 32 attached to two-sided tape 33. Without using foam-tape that can handle the temperature, the metal strip can slip off the foam. On the other side of the foam, where it connects to the toner hopper, it can slip off if it is not a high-to-medium temperature material. It should at least be designed to work in the temperature range of the imaging device.

Another version of these embodiments would be to coat the felt pad with a conductive material on its outer surface. For example, coatings containing graphite, carbon black,, gold, silver, platinum, or aluminum are suitable to coat the felt pad. Alternatively, it may be coated with a conductive grease.

Figure 10:
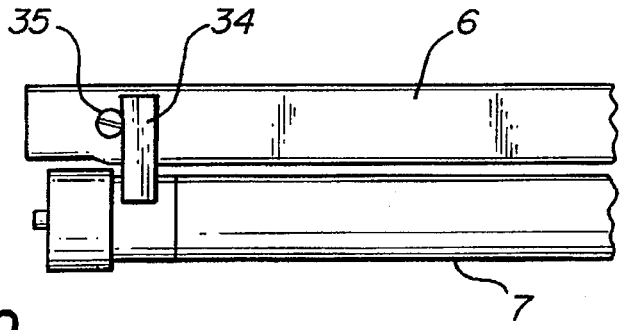
FIG. 10 illustrates a simpler embodiment of the bias voltage connector for use with other types of cartridge assemblies.
Figure 11:
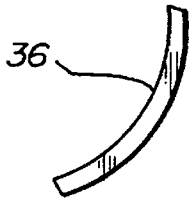
FIG. 11 shows a type of flat wire that may be used as a bias voltage connector.

FIG. 10 illustrates a toner cartridge assembly, such as the NX type, where a plastic member 14 with scraping extension 15 is not used. In this type of cartridge assembly, a simple bias voltage connector 34 may be secured with the screw 35 which helps hold the doctor blade 6 on the assembly. The connector 34 in this case does not need to be taped or bent. But the user could bend the connector 34 to fit the assembly environment and the contour of the developer roller 7. FIG. 11 shows a type of thin, flat wire 36 which may be used in place of the bias voltage connectors 25 and 34.

It has been found to be advantageous in some instances and is previously known in the art to modify the bias voltage supplied to the developer roller 7 with a resistor. This is already done in the printer when the bias is adjusted with a dial or lever. However, the range of the bias adjustment is not always large enough and may be increased with an external bias adjuster. With the normal bias voltage connector of this invention, made of highly conductive material, the voltage is not modified. However, by using a resistance the voltage may be modified and therefore the attraction of the toner from the developer roller to the photoreceptor drum may be modified. In some cases, it may need modification. For example, some toners are too "dark" in print, causing a grey background. Also, some photoreceptor drums may also print too dark or too light. A good example is in the NX printer. In other words, there are many versions of toners and photoreceptor drums, each of varying capacities of enhancing print density. It is the combination of the toner and photoreceptor drum as a set that really determines darkness, since they each have such a great influence. There are two bias voltages that charge the developer roller as briefly described. More specifically, one is an AC voltage and the other is a DC voltage. The AC and DC voltage is variable with the printer's bias adjustment dial that changes the voltage, operated by the enduser. In some cases, the DC is adjusted, although they may both be adjusted. When the enduser wants darker print, he adjusts the dial one direction and when he wants it lighter, he adjusts it the other direction. Unfortunately, the OEM manufacturer made it so that the bias adjustment scale is not always what one wants. For example, when a fairly dark toner/drum combination is used, it is already too dark and it is desired to lighten it up with this adjustment. However, the scale as commonly seen in the NX cartridge is occassionally useless, because sometimes one wants to adjust it to a level beyond the distance of the scale of the bias adjustment knob. The same problem can exist when it is too light. Consequently, the scale is shifted relative to what is desired. So, the next part of this invention compensates, shifts the scale, or in other words controls the bias density setting from the cartridge. This is done by using the bias voltage connector as a resistor to change the voltage.

Figure 12:
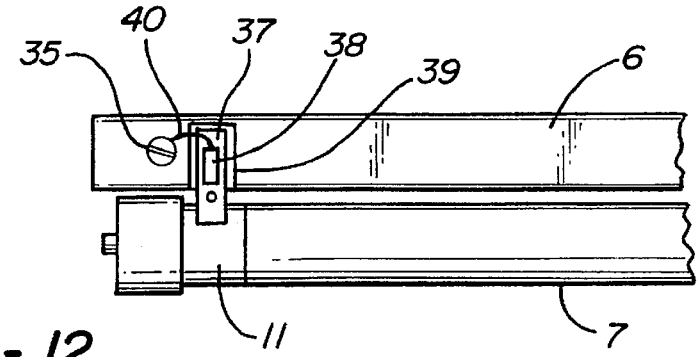
FIG. 12 shows an embodiment of the bias voltage connector which uses a resistor to modify the voltage.

The bias voltage connector may be used as a resistor in a number of dfferent ways. FIG. 12 shows a bias voltage connector 37 with a resistor 38 soldered to the connector 29 surface. The connector 37 is attached to the doctor blade 6 with an electrically insulative two-sided tape 39. One end or wire 40 of the resistor 38 is attached to the charged doctor blade 6 by the screw 35.

Figure 13:
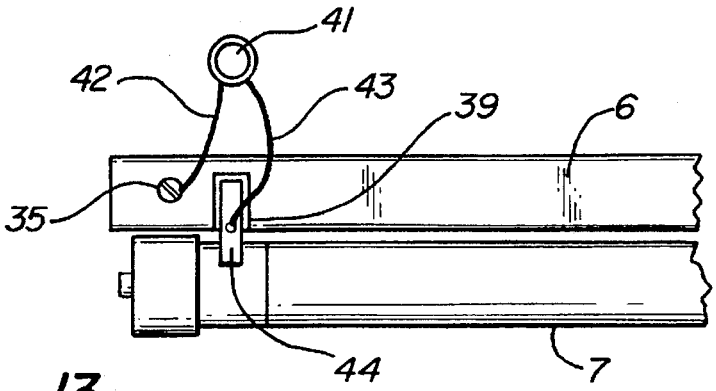
FIG. 13 broadly depicts how a variable resistor could be used with the bias voltage connector.

As an alternative, a variable resistor or potentiometer 41, as broadly depicted in FIG. 13, may be used. Some variable resistors consist of potentiometers. Others have a bank of resistors, each switchable from one resistance to another by dialing a dial, setting a switch, or even setting a dipswitch. The dial of the variable resistor or potentiometer 41 may be on the outside of the printer, copier or facsimile machine or on the cartridge asssembly itself. It might be slightly inconvenient to have to open the printer door every time an adjustment is to be made. The same can be done with a dipswitch, where the dipswitch is attached to the cartridge assembly case or outside the machine. At any rate, the variable resistor or potentiometer 41 may comprise a wire 42 forced into contact against the charged blade 6 by screw 35 at one end and connected to the variable resistor or potentiometer 41 at the other end. A second wire 43 would extend from the variable resistor or potentiometer 41 into contact with the bias voltage connector 44. So the voltage from the blade 6 through the connector 44 to the developer roller 7 may be modified as selected. By testing the refilled toner cartridge assembly on a printer with this feature, the toner supplier can quickly determine what resistance is needed for a given batch of toner. Then the toner supplier can give out a resistor of the correct resistance with every bottle of toner for a given batch. Also, this device could be used by toner manufacturers to test toner batches. A curve could be generated for a certain toner component composition that enhances darkness as a function of the potentiometer setting. Consequently, one could design a toner that is extremely light or dark, off the normal bias setting scale to "lock-in" a customer. Once the toner manufacturer designs the toner, a bias connector of correct fixed resistance can be then supplied with the toner. Then other toners would fail by being too dark or too light. This would be too complicated using resistors and potentiometers, however, would be practical if a fixed resistance was built into a bias connector of any embodiment of this invention. Thus the toner manufacturer can send a custom bias connector with a shipment of toner. This will also help the toner manufacturer sell off-spec toner. The resistance can be built into the bias connector by using resistive materials or alloys in the manufacturing process. Plating with resistive materials can also be used to this end.

Figure 14:
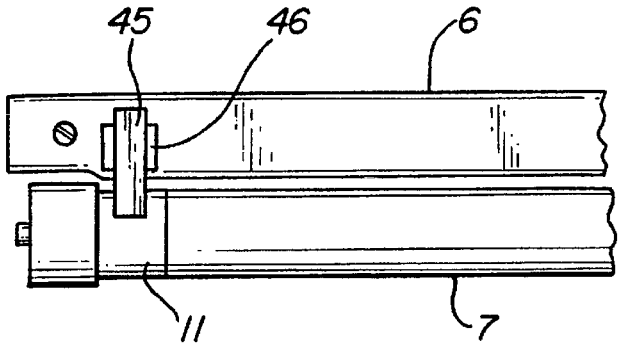
FIG. 14 illustrates the use of a metal shim as a resistor.

FIG. 14 shows another way to modify the voltage. The bias voltage connector 45 could sandwich a shim 46 made of a metallic material with a known resistance between the connector 45 and the doctor blade 6. The connector 45 and shim 46 could be attached to the blade 6 by tape or other adhesive.

Figure 15:
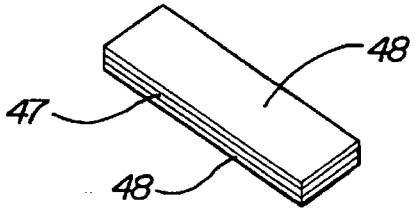
FIG. 15 is an enlarged view of a bias voltage connector plated on each side with a resistive material.

Another version of the invention would have a bias voltage connector 47, as illustrated in FIG. 15, with a resistive material 48 plated on one or both sides of the connector 47. Or the bias voltage connector 34 shown in FIG. 10 could simply be made of a material with the desired, known resistance. It should also be noted that embodiments of this invention including the electrically resistive features could be used with the bias voltage connectors for attachment under the doctor blade 6, as described with respect to FIGS. 4–7.

There is another reason why it is desirable to control the bias to a greater extent than the scale allows. It has to do with the operating environment. Most endusers using laser printers and copiers do not have total control of temperature, pressure, and humidity. Endusers at high altitude, for example, have much difficulty. Furthermore, endusers in dry climates have problems frequently. For example, the printers and copiers are generally designed for relative humidity between 20 percent to 80 percent. Typically what happens is that the humidity outdoors may get to 60 percent, however the outdoor temperature in winter can often reach ten degrees below zero Fahrenheit. In my climate, last winter, I have seen many such cold days, even though there were not so many the previous year. Sixty percent humidity outdoors at ten degrees below zero then equates to less that 20 percent humidity indoors at seventy degrees Fahrenheit. Consequently many "static electricity" problems occur when the humidity decreases below 20 percent and problems may occur when the relative humidity exceeds 80 percent. Twenty to 80 percent relative humidity is the "design" operating window for copiers and laser printers.

At one of these low humidity times, when the humidity decreases below 20 percent, it throws off the bias adjustment. The bias adjustment scale is not always large enough to compensate for this humidity drop. An external scale adjustment control is desired. For example, the bias voltage provides charge on the toner such that the toner is attracted from the developer roller to the photoreceptor drum, but it will only go to pixels on the photoreceptor drum where the charge has been partially discharged by laser light. However, overly low humidity can cause the toner to be more attracted to the photoreceptor drum than in acceptable humidity conditions to the point that excess unwanted toner can be attracted to the drum, causing a gray haze on the output page or causing ghosting.

Figure 16:
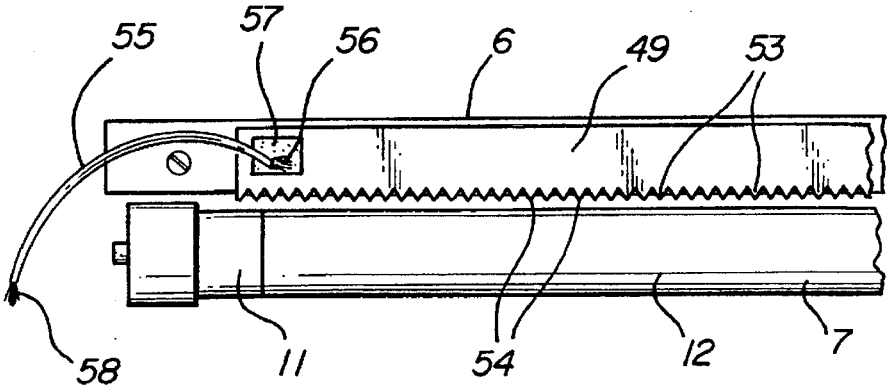
FIG. 16 shows the static limiter device of this invention.

Others have tried to improve static problems in dry conditions in various ways. One way has been to spray antistatic spray in the vicinity of the printer environment. People have even tried spraying an antistatic spray in the vicinity of the developer roller to eliminate the problem. However, this solution has only worked for a limited time. For example, after less than one hour of printing, the problem returns when using this technique. However, the static in the vicinity of the developer roller 6 may be permanently controlled by using the invention illustrated in FIG. 16.

The static limiter device comprises a length of metallic sheet or foil 49 approximately equal to the length of the toner transport section 12 of the developer roller 7. The metallic sheet or foil 49 is attached to the doctor blade 6. It must be insulated from the metal of the blade 6. This may be done by attaching the static limiter device to the blade 6 with insulative material layered in between. The insulative material may be an insulating tape or adhesive. A metallic tape can be used to do it all in one step.

Figure 17:
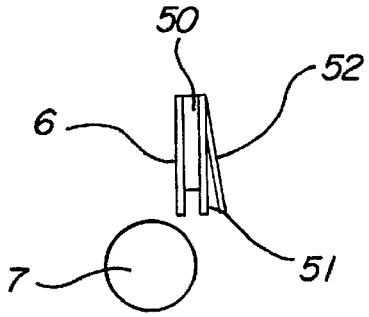
FIG. 17 is an end or sideview of the static limiter device.

A foam-type two-sided tape 50, as shown in FIG. 17, may be used to increase the distance between the metallic sheet or foil 49 of the device and the doctor blade 6 while adhering the metallic sheet or foil 49 to the blade 6 and electrically insulating it from the blade metal. The metallic sheet or foil 49 may be folded, as shown by the end or sideview of FIG. 17, such that there are two layers 51 and 52. Zigzags forming sharp metal teeth 53 are cut in the edges of the metallic sheet or foil 49 adjacent the developer roller 7. The point 54 of each tooth 53 acts as a static limiter when the metallic sheet or foil 49 is grounded by a wire 55. The wire 55 is attached to the metallic sheet or foil 49 at one end 56 by tape 57 or other adhesive. The other end 58 of the wire 55 is attached to ground. Grounding is adequate. However, there may be cases where it is desired to provide the metallic sheet or foil 49 with a charge opposite to the developer roller bias to adequately diminish the static electricity. In those cases the end 58 of the wire 55 would be attached to a source of opposite charge.

FIGS. 18 and 19 show an alternative to using the 14 foil 49 for the static limiter device. In this embodiment, the static limiter device is a mesh metal screen 59 with points 60 extending to adjacent the developer roller 7. The screen 59 with points 60 performs the same function as the metallic sheet or foil 49 with teeth 53.

The static limiter device regulates the maximum electrostatic charge. It essentially sets a limit on effects of the bias voltage from environmental conditions such as humidity, altitude, and air pressure to regulate the effective bias voltage for a more consistent print quality. With the static limiter device the operating conditions of the printer, copier or facsimile machine may be increased. Consequently, operating below 20% relative humidity (at room temperature) is no longer a limit.

One may use both the static limiter and the bias voltage connector with resistive properties at the same time to solve problems associated with unusual conditions such as dry weather problems. When used together and when used alone, both devices, however, may increase the "design" low humidity tolerence. As a result of both embodiments of the invention, the range of operating conditions may be increased. A machine able to operate at a larger range of conditions, is a better machine. It will have a longer life, have fewer defects, will run better, have greater reliability, and will cause endusers to choose a printer that does not require humidifiers to add moisture to the air. Although one would think that the modern office building would have better conditions in cold weather, it is not true. For example, many buildings replace the air up to six times per hour. Consequently, fresh dry air is brought in from outdoors, heated up to dry it more, and then is circulated in a building. This doesn't mean that an older building is any better. Older buildings, when air is heated up in the winter, often have the same problem, but particularly have stale dry air unevenly spread in the building. Desert climates have these conditions most of the time, while high altitude printing and copying is also a problem. Consequently, it is important to have this invention to increase the numbers of users and the range of what otherwise would be unfavorable printing conditions.

The previous embodiments of a bias voltage connector for developer rollers are functional. However, two other embodiments have further improved the developer roller operation. The previous embodiments require a certain amount of skill and time in installation just like the prior art bias clip 1. The last two embodiments, as illustrated in FIGS. 20–24, require no skill or installation tool to place the contact and do not cut into the developer roller. These embodiments are designed around the structure of a typical developer roller which has 2 diameters or a step in diameter where the original bias voltage contacts touch, which will be used as a stop, and thus no skill is required. The installer only has to place the device inside the developer roller 7 against the stop, so the stop sets the placement.

FIG. 20 broadly illustrates how a developer roller 7 attaches to a toner cartridge assembly 5. The developer roller 7 decreases in internal diameter an three eighths of an inch or so in from its end 61. This decrease in internal diameter, or step in internal diameter, provides a locater or stop 62 for this embodiment of the bias voltage connector so the device will always be perfectly positioned and aligned and in this respect will be foolproof. Thus, using the technique of installation can not inadvertantly misposition the device even one wants to. The reduced internal diameter 63 of the developer roller 7 receives the magnetic core 10 (not shown in this drawing).

There is a stainless steel welded-washer subassembly 64 which is part of the printer contact spring assembly 71 in a plastic cap assembly 65. The plastic cap assembly 65 receives part of the nonprint region 11 of the roller 7 and the washer 64 receives the protruding end of the magnetic core 10. The end 61 of the roller 7 slides over the welded-washer subassembly 64. The welded-washer subassembly 64 is a subassembly of the printer contact spring assembly 71 which also contains the printer contact 72 which is connected to the bias voltage source through a printer contact. In prior art bias voltage connections, a helical spring assembly and/or coil spring inserted inside the end 61 of the developer roller 7, as discussed in the Background, would provide the bias voltage connection between the stainless steel welded-washer subassembly 64 and the developer roller 7. Applicant has found that the devices shown in FIGS. 21 and 22 provide more reliable, easier to install, and longer-lasting electrical connections.

FIG. 21 shows the first embodiment. A contact device 66, preferably made of metal, has a diameter just slightly smaller than the internal diameter of the end 61 of the developer roller 7. The contact device 66 is made of an electrically conductive material, such as steel, stainless steel, copper, brass or bronze and has a hole 67 through which the protruding end of the magnetic core 10 can extend. The contact device 66 snugly fits in the end 61 of the roller 7 where it contacts both the developer roller inside wall and the stop 62. When the developer roller 7 is mounted on the toner cartridge assembly 5, the contact device 66 is pressed against the welded-washer subassembly 64 in the plastic cap assembly 65 that holds the printer contact. Reliable electrical contact between the bias voltage source and the developer roller 7 is provided, since the contact device 66 is held securely in place between the welded-washer subassembly 64 and the stop 62. Depending on the width of the contact device 66, tension or force of contact between the welded-washer subassembly 64 and the contact device 66 can be adjusted by the screw 74 which secures the end piece of the cartridge assembly 5 to the assembly, and the roller within the assembly, at the other end of the developer roller 7.

In the second embodiment, illustrated by FIG. 22, the contact device 68 has two small holes 69 drilled into its circumference or outside diameter. Tiny springs 70 are received by the holes 69. When the contact device 68 is placed in the end 61 of the developer roller 7 against the stop 62, the springs 70 exert a force against the inside wall of the developer roller 7, tightly fitting the contact device 68 within the roller 7 and ensuring good electrical contact between the contact device 68 and the developer roller 7. There can be any number of holes 69 and springs 70 located at different positions around the circumference of the contact device 68.

Figure 24:
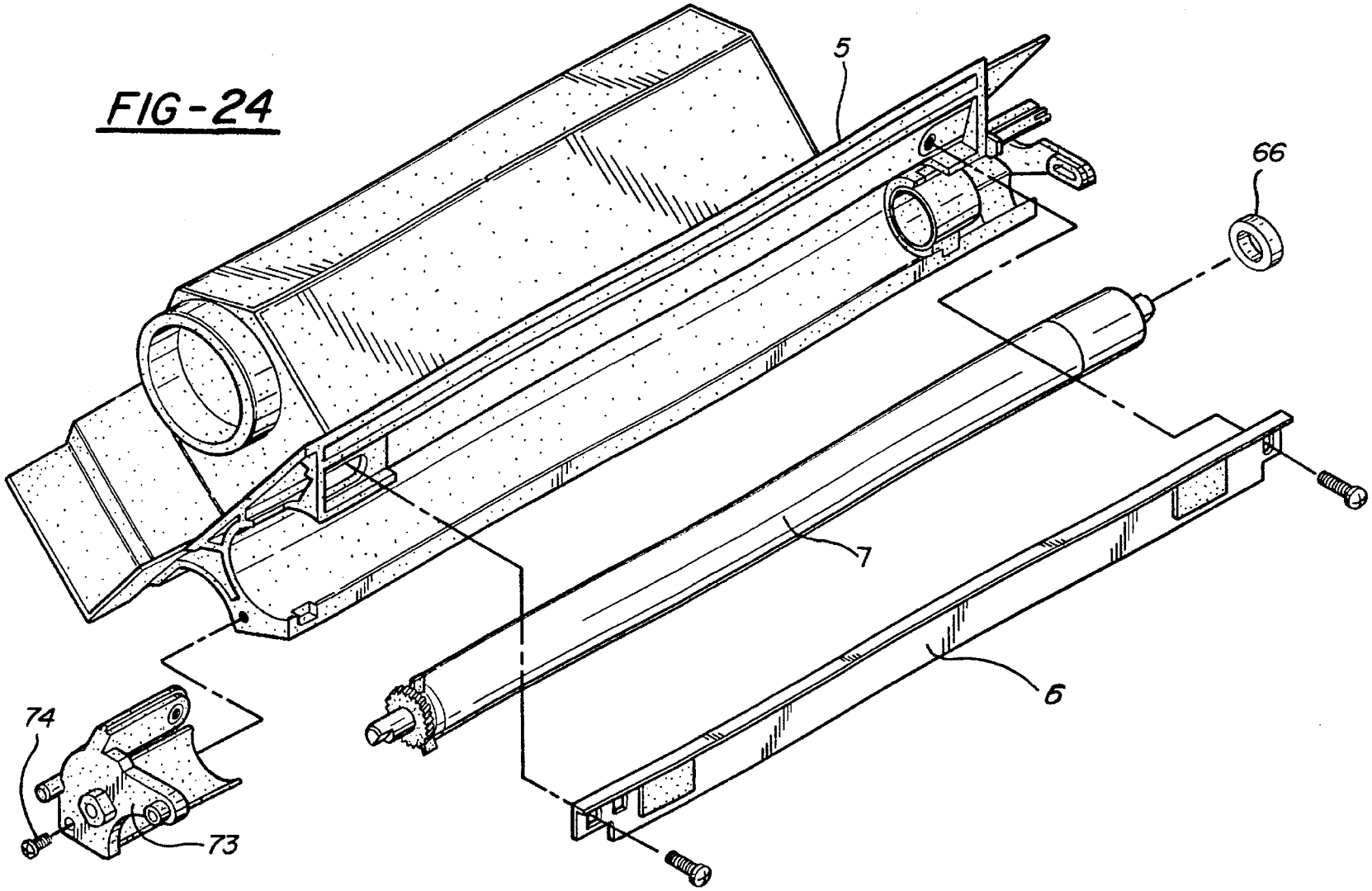
FIG. 24 shows how the entire assembly (with the internal contact device) is put together.
Figure 23:
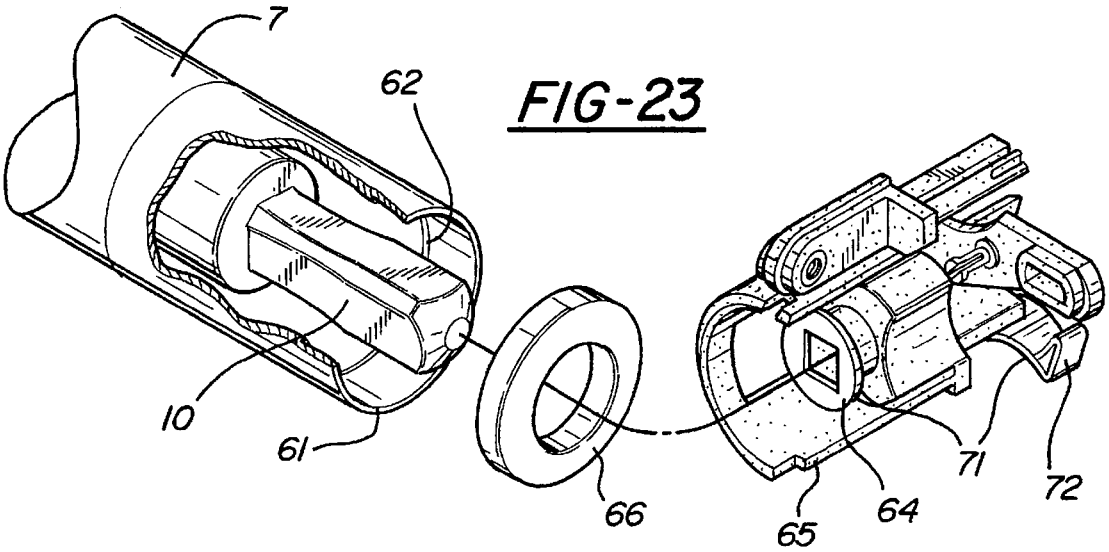
FIG. 23 illustrates in more detail the placement of the contact device relative to the developer roller and printer electrical contact.

FIG. 23 and 24 are more detailed illustrations of the placement of the contact device 66 (or contact device 68) within the developer roller 7, and the placement of the developer roller 7 into the cartridge assembly 5 relative to the doctor blade 6. Note that the welded-washer subassembly 64 is extended in a one piece printer contact spring assembly 71 to the printer electrical contact 72. FIG. 24 also shows the plastic endpiece or endcap 73 attached by a screw 74 to the assembly 5, which, as previously mentioned, can be used to adjust the tension or force of contact between the welded-washer subassembly 64 and the contact device 66. Please note that the contact device 66 and welded-washer subassembly 64 section of the printer contact spring assembly 71 are not drawn to scale and in actuality, the welded-washer subassembly 64 and contact device 66 are approximately of the same or similar outside diameters.

Thus a simple-to-install contact device has been provided. However, manufacturing a component with the holes 69 and placing in tiny springs 70 increases the manufacturing time and thus increases the manufacturing costs. The first embodiment was designed to decrease costs. Since the contact device 66 is only slightly smaller than the internal diameter of the developer roller, electrical contact is ensured. But with either embodiment, the installer merely places the tight contact device inside the developer roller, and thats it. No tools are needed to set it. Also, greater metal-metal surface contact is achieved with this design.

There are some further advantages of this embodiment. First, this contact device 66 may be manufactured with great precision. Thus, when it presses against the inside wall diameter stop 62, it not only increases its surface contact for better and more precise mechanical connection, but also increases its surface contact for better electrical connection. With a precision diameter change already built into the developer roller 7, the precisely made contact device 66 will be perpendicular to the developer roller 7, also with great precision. Thus, when the contact device 66 rotates with the developer roller 7, it will not only remain in contact with the bias voltage source to the imaging device (welded-washer subassembly 64), but will do so with much less friction than with prior art by the OEM manufacturer with their helical spring, but will also do so with less friction than with any improvements that have been made since in an attempt to correct the problem. This can be backed up by tests made using the Canon NX engine printer family. The NX toner cartridge toner hopper has an inherent problem. This problem involves rotation of the developer roller 7. As the developer roller rotates, there is a very great stress required to rotate the developer roller caused by two mechanical resistances. The first resistance is caused by the toner agitation paddle used to break up any lumps and keep the toner in good operating condition. The second resistance is caused by the spring force of the helical OEM contact spring. The spring force causes unnecessary frictional resistance that prevents the developer roller 7 from rotating. Another inherent problem that this invention helps solve is the breaking of the printer gear that drives the toner cartridge because when this gear breaks one or more teeth, it is a major repair job in the best case. A repair of this magnitude will typically cost $1000.00 or more. By minimizing mechanical resistance, the developer roller can turn easier, and it will then be much less likely to cause the printer's drive gear to break. One reason this is an expensive repair is because the gear that typically breaks is not available as a gear and is only available as an entire gear assembly unit and typically when this complex gear assembly is replaced, a second gear assembly is replaced at the same time as a precaution because it may also be damaged. Furthermore, when this gear assembly is replaced it is a major job because it requires disassembly of a large amount of the printer. Thus, by using the contact device 66 in the NX printer, it relieves a good amount of mechanical resistance to allow the developer roller 66 to operate much better. Any cartridge technician can feel the difference in ease of turning the developer roller 7 between prior art springs and the contact device 66 by rotating a developer roller with one's thumb on the drive gear, a test step done by a cartridge technician when remanufacturing a toner cartridge, even prior to this invention. All prior art except for the clip 1 (which has the disadvantage of cutting into the developer roller outer wall involves the use of a spring in some way. This device requires no spring and, thus, has less mechanical resistance. With the benefits that this contact device 66 has in the NX cartridge that are noticable to a cartridge technician when remanufacturing a cartridge, the benefits of placing the contact device 66 into a SX, PX, EX, LX, BX, or other developer roller that does not have this known problem is substantial because even if there is no known problem in the other cartridges, just the fact that it turns easier with much less mechanical resistance indicates that there is less wear on the gear mechanisms, less wear on the motor and thus the imaging device should last a much longer time. Should the OEM manufacturers design new imaging machines using this contact device 66 in the future, they would be able to decrease the cost of the imaging device by using a less powerful drive motor, thus the cost of designing future imaging machines will be greatly reduced by using this contact device 66.

Figure 25:
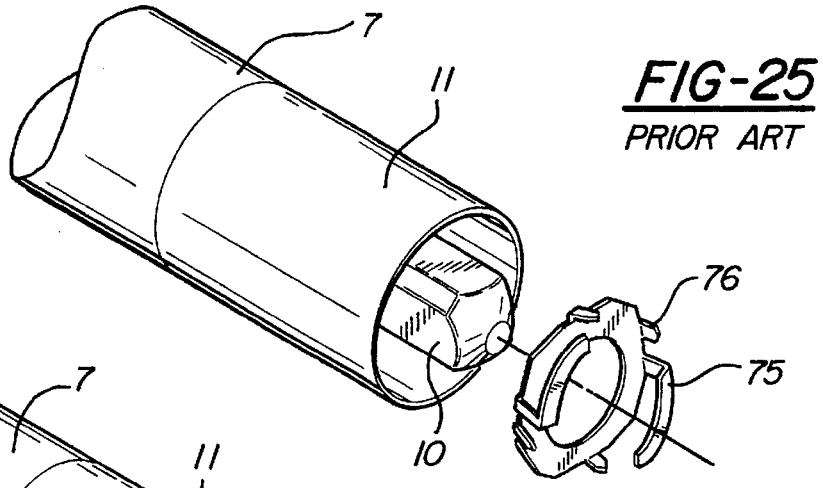
FIG-25 PRIOR ART
FIG. 25 is an illustration of the prior art helical spring contact device.
Figure 27:
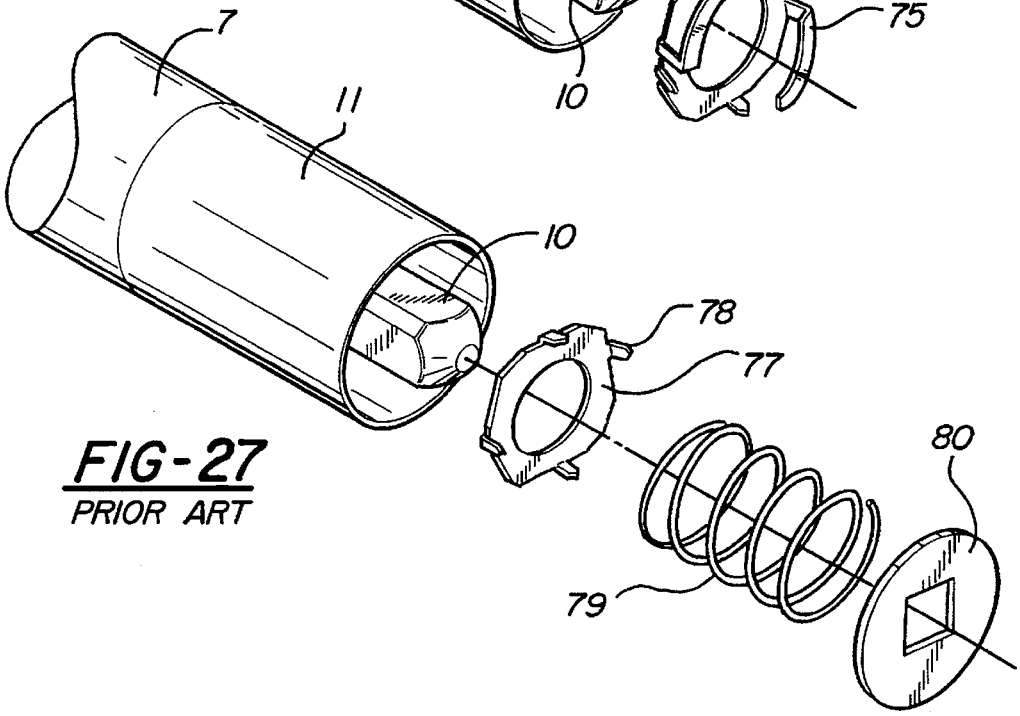
FIG-27 PRIOR ART
FIG. 27 is an illustration of the prior art replacement contact device, which includes a metal ring and coil spring.
Figure 26:
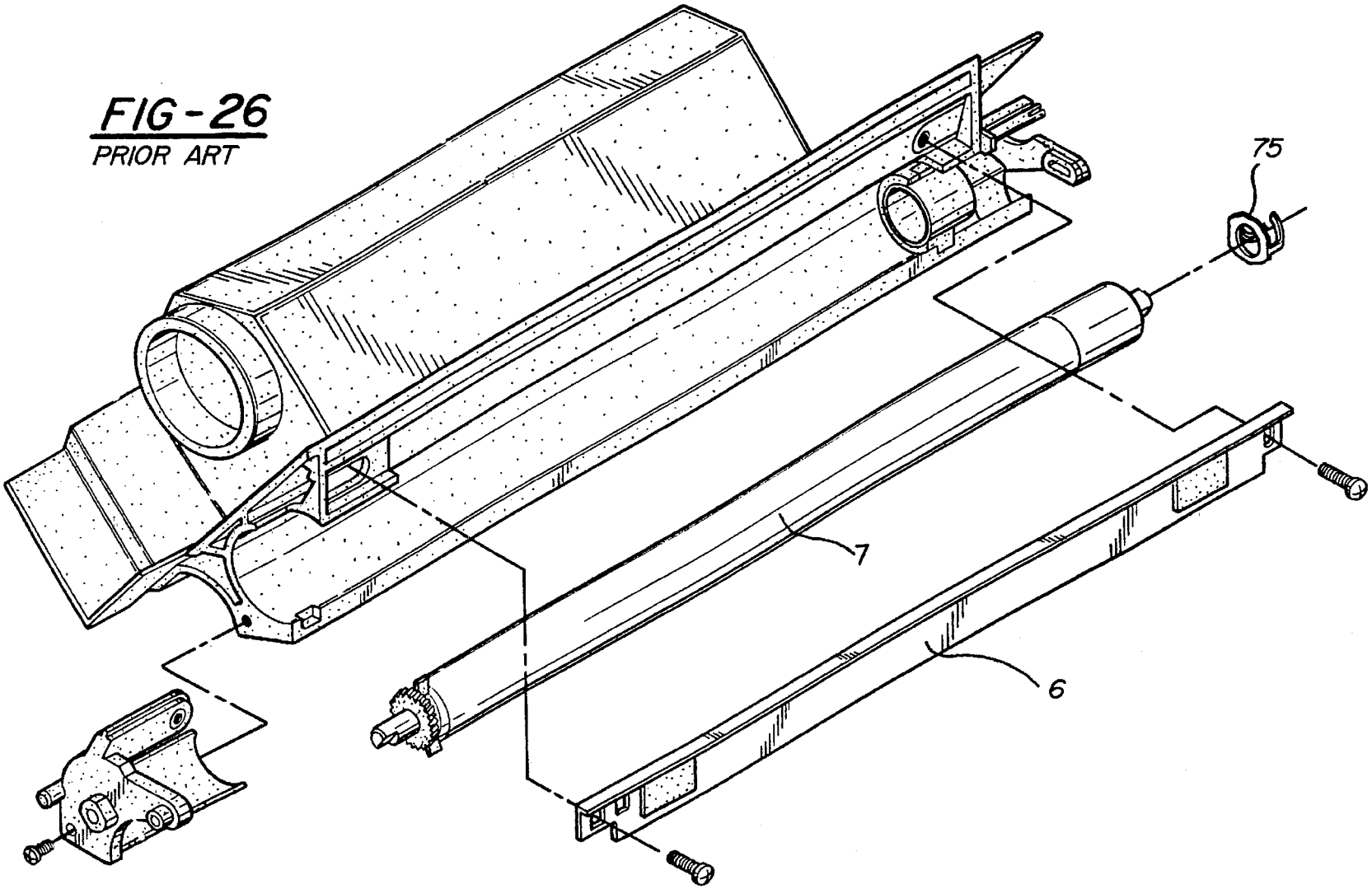
FIG-26 PRIOR ART
FIG. 26 shows how the entire assembly (with the prior art contact device) is put together.

FIGS. 25–27 show prior art electrical connections. The intent behind illustrating these old connections is to further distinguish the present invention from the prior art and demonstrate the significance of the contact devices 66 and 68. As previously discussed and as illustrated in FIGS. 25 and 26, a helical spring 75 was used as one type of OEM contact device.

Another advantage of using the contact device 66 is that prior art OEM helical contact 75 cuts into the inner wall of the developer roller 7 with four little catches 76 (some versions use two catches 76) that eventually come loose, thus causing an unplanned defect. By using the contact device 66, contact is not only maintained around the outer circumference of the contact device, but also contact is made along the edge surface where the diameter of the inside of the developer roller 7 changes at the stop 62.

FIG. 27 shows a prior art replacement contact device comprising a metal ring 77 with catches 78 for cutting into the inner wall of the developer roller 7. A coil spring 79 keeps the ring 77 in the developer roller 7 while pressing a metal washer 80 against the welded-washer subassembly 64 connected to the printer electrical contact 72.

Another advantage of the contact device 66 is that most prior art contacts involve springs such as helical springs 75 or coil springs 79. In each case, the force of the spring against the printer contact welded-washer subassembly 64 is where electrical contact is made. In the typical spring force equation, force equals the spring constant multiplied by the distance that the spring is moved. However, all such light duty springs in time lose their resilience and thus the spring constant in the equation changes with time. Also the distance from equalibrium state changes in time with continued use as the spring loses its resilience. In any event the properties of the spring change with time and both the mechanical resistance and the quality of electrical contact change in time. Thus consistency is does not occur with prior art. With the contact device 66, on the other hand, there is consistency, because there is no spring involved where properties may change in time.

As stated, the position of the contact device 66 is very precise and thus minimizes mechanical resistance and friction as the developer roller 7 and contact device 66 rotate with respect to the welded-washer subassembly 64, the contact to the printer. Along with the major decrease in mechanical resistance comes a decrease in wear of both the rotating contact device 66 and the stationary printer contact (welded-washer subassembly 64) and thus defects are less likely. According to projections, the contact device 66 should last in excess of 50 cartridge cycles, possibly much larger. It does not seem to wear out in testing. It has been tested both with and without conductive grease and works well in each case. The spring version contact 68 has been tested extensively and it lasts very well. Version 66 has not been tested as long but it should have all the same benefits with added benefits resulting from the precision enhancements. The contact device 68 did not position itself precisely like the contact device 66 which thus performs even better. In all the years that this technology has been around, nobody has ever used a non-spring device for electrical contact for a developer roller 7 except for the clip 1 which has the several problem previously described. Perhaps it was too simple of an idea for all the "experts" to think of. The SX engine with the major problem of uneven darknes has been around since 1987, and this simple solution has not been invented until recently after tens of millions of the prior art technology SX toner cartridges have been used in the field, as well as others. Furthermore, the inherent uneven darkness problem goes away when using the contact device 66 because a good solid electrical connection is made when using the contact device 66 as opposed to the OEM helical spring 75 whose only electrical contact with the inner wall of the developer roller 7 is four little prongs 76 (some versions use two prongs 76) that dig into the inner wall and eventually loosen. Thus, it is no surprise that there is an uneven darkness problem with the OEM spring contact 75.

It should be noted that either contact device 66 and 68 may be made of resistive material to apply a known electrical resistance on the bias voltage for different weather conditions. Alternatively, the contact devices 66 or 68 may be plated or partially plated with resistive material in order to attain an electrical resistance.

It should be pointed out that the contact device 68 preceded the contact device 66. The contact device 68 was tested extensively and functioned fine. It had advantages of less wear and great consistency. However, when manufacturing was being considered, tests were made of the nonspring version 66. It was found, however, that the nonspring version 66 had numerous advantages over its predecessor 68. First, the contact device 68 has less surface contact with the inside wall of the developer roller 7. Second the contact device 68 was not precisely perpendicular to the inside wall of the developer roller but was still far superior to the prior art whereas the device 66 is precisely perpendicular. Third, the contact device 68 did not position itself with great precision like the contact device 66. This caused a problem because there was a great amount of difference in position from one contact device installed to the next, even if the same contact device 68 was re-installed. Thus, there were many cases where it was tight with respect to the assembly of the developer roller and when the plastic endcap was tightened, it was too tight and it was adjusted by loosening the screw. With the contact device 66, however, with its great precision, it has been designed to be foolproof so that the technician can not overtighten the endcap by accident. Fourth, the contact device 68 had to be thicker in width which makes it more expensive. Fifth, the contact device 68 was not as large in diameter in order to fit in the springs, thus decreasing its electrical surface contact area because it only contacted the inner wall where the springs pushed it and also contacted on the opposing side. Although two springs 70 are used in the figure more springs may have been used. Sixth, the contact device 66 is less expensive to manufacture than the contact device 68 because drilling the side holes and placing tiny springs in the holes significantly increases the manufacturing costs. Seventh, the contact device 66 also reinforces the hollow open-ended aluminum developer roller 7 at the open end where it is weak, similar to an open can, and by reinforcing the weak open end of the developer roller 7, the now reinforced developer roller 7 stays true round, even when constant force is exerted on the developer roller 7 as it rotates, which is a major improvement over the prior art, and thus, the quality of the printed image is further enhanced by keeping the distance from the rotating developer roller to the rotating photoreceptor drum more consistent, since the rotating developer roller 7 is more round. Consequently, the contact device 68 testing was a major success. This led to the contact device 66 which has many advantages over the contact device 68, listed above. So, one puts together the successful testing of the contact 68 and now add all the improvements of the contact device 66, it can only be concluded that the contact device is a major improvement in the art, as simple as it is. Product testing has proved its worthiness as a product regarding the contact device 66.

As newer imaging machines are being developed at the high end with faster speed and at the low end with low cost, a simple product such as the contact device 66 can decrease costs and have a more consistent and reliable performance. Because of this development, smaller drive motors may be used for a further cost reduction. A simple contact device 66 is like an insurance policy. For the low cost, it ensures that uneven darkness will not occur and prevents the gears from getting damaged in the NX developer roller. This is a small extra cost for a cartridge remanufacturer to replace the OEM helical contact spring with the contact device 66. For each one replaced, there is less chance of a problem occurring. Also, much discussion exists on how to properly install the OEM helical contacts 75. With the contact device 66, it is simply placed in the developer roller 7 end 61. So, if it makes sense to replace the prior art contacts with those of this invention, just think of how much sense it would make for the OEM manufacturers to license this invention and use this contact device 66 in brand new OEM machines and cartridges in the first place. Furthermore, a simple solution that is an improvement is the best solution. Oftentimes the solution to a problem can be a more complex and costly device. That is not so in this case.

Since minor changes and modifications varied to fit particular operating requirements and environments will be understood by those skilled in the art, the invention is not considered limited to the specific examples chosen for purposes of illustration. The invention includes all changes and modifications which do not constitute a departure from the true spirit and scope of this invention as claimed in the following claims and as represented by reasonable equivalents to the claimed elements.

What is claimed is:

1. A toner cartridge assembly comprising:

a toner cartridge housing;

a developer roller rotatably supported by said housing and including a toner-receiving region and a non-toner-receiving region;

an electrically conductive doctor blade supported by said housing parallel to said toner-receiving region of said developer roller and spaced from said developer roller;

an electrically conductive bias voltage connector mounted on said doctor blade and contacting the surface of said non-toner-receiving region of said developer roller without contacting said toner-receiving region of said developer roller;

said bias voltage connector including a thickness;

said bias voltage connector being sandwiched between said doctor blade and said non-toner-receiving region of said developer roller creating a space between said doctor blade and said toner-receiving region of said developer roller equal to said thickness of said bias voltage connector, whereby said thickness of said bias voltage connector can be selected to create a desired gap between said doctor blade and said toner-receiving region of said developer roller to optimize the performance of said doctor blade and said developer roller.

2. A toner cartridge assembly as set forth in claim 1 wherein said doctor blade includes a width;

said bias voltage connector including a center section having a length equal to the width of said doctor blade, a first end bent upwardly with respect to said center section and placed in contact with said developer roller, and a second end bent upwardly with respect to said center section, whereby said bias voltage connector forms a substantially arcuate cross-section adapted to firmly cradle said doctor blade.

3. A toner cartridge assembly as set forth in claim 2 wherein said bias voltage connector is made of a resilient material.

4. A toner cartridge assembly as set forth in claim 1 wherein said cartridge assembly includes a pad for sealing an end of said developer roller, and said bias voltage connector is attached to said pad such that said bias voltage connector contacts said doctor blade and said developer roller.

5. A toner cartridge assembly as set forth in claim 4 wherein said bias voltage connector is attached to said pad by a foam-type two-sided tape.

6. A toner cartridge assembly as set forth in claim 1 wherein a resistor is attached to said bias voltage connector, whereby the bias voltage may be modified.

7. A toner cartridge assembly as set forth in claim 6 wherein said resistor has an end or wire which is in contact with said doctor blade, and said bias voltage connector is insulated from said doctor blade.

8. A toner cartridge assembly as set forth in claim 6 wherein said resistor is a variable resistor or potentiometer.

9. A toner cartridge assembly as set forth in claim 1 wherein said cartridge assembly includes a seal for sealing an end of said developer roller, said seal comprising a piece of foam, and said bias voltage connector comprising a metal strip secured to said piece of foam and contacting said doctor blade and said developer roller.

10. A toner cartridge assembly as set forth in claim 9 wherein said metal strip is secured to said piece of foam by two-sided tape.

11. A toner cartridge assembly comprising:

a toner cartridge housing;

a developer roller rotatably supported by said housing;

said developer roller including an outside surface and an inside wall defining a hollow segment within said developer roller;

said inside wall including an area of reduced diameter within said hollow segment to form a stop spaced from one end of said developer roller;

an electrically conductive stationary printer contact supported by said housing;

an electrically conductive bias voltage connector contiguous said printer contact, said inside wall of said developer roller, and said stop; and said bias voltage connector comprising a circular disc having a smooth outer periphery.

12. A toner cartridge assembly as set forth in claim 11 wherein said bias voltage connector includes a plurality of holes spaced about said outer periphery thereof, each hole including a spring disposed therein and extending outwardly therefrom into contact with said inside wall of said developer roller.

13. A toner cartridge assembly as set forth in claim 11, wherein said bias voltage connector is coated with a resistive material having a resistance greater than said bias voltage connector.

14. A toner cartridge assembly as set forth in claim 11 wherein said bias voltage connector is coated with a conductive grease to improve the electrical connection between said bias voltage connector and said contact device, said stationary printer contact, and said inside wall of said developer roller.

15. A toner cartridge assembly as set forth in claim 11 including an adjustable pressure applying device for maintaining pressure between the bias voltage connector, the stationary printer contact, and the stop on the developer roller.

16. A toner cartridge assembly for limiting the static charge on a developer roller, said assembly comprising:

a toner cartridge housing;

a developer roller rotatably supported by said housing and including a toner-receiving region and a non-toner-receiving region;

an electrically conductive doctor blade supported by said housing parallel to said toner-receiving region of said developer roller and spaced from said developer roller;

an electrically conductive bias voltage connector mounted on said doctor blade and contacting said non-toner-receiving region of said developer roller without contacting said toner-receiving region of said developer roller;

an electrically conductive static limiter strip attached to said doctor blade and disposed adjacent said developer roller in a spaced relationship therefrom; and a layer of insulating material disposed between said static limiter strip and said doctor blade whereby said static limiter strip can remove a static charge from said developer roller without interfering with the ability of said doctor blade to apply a desired electrical bias to said developer roller.

17. A toner cartridge assembly as set forth in claim 16 including a first electrically conductive member joining said doctor blade to a first voltage potential source.

18. A toner cartridge assembly as set forth in claim 17 including a second electrically conductive member joining said static limiter strip to a second voltage potential source.

19. A toner cartridge assembly as set forth in claim 17 including a second electrically conductive member joining said static limiter strip to electrical ground.

20. A toner cartridge assembly as set forth in claim 16 wherein said static limiter strip comprises a section of electrically conductive material folded to form multiple edges and joined to said doctor blade such that at least two edges of said static limiter strip are disposed adjacent said developer roller.

21. A toner cartridge assembly as set forth in claim 16 wherein said static limiter strip comprises a length of metallic material having one or more edges adjacent said developer roller, said one or more edges being cut to form multiple pointed teeth.

22. A toner cartridge assembly as set forth in claim 16 wherein said static limiter strip comprises a metal screen with points extending toward and adjacent said developer roller.

23. A bias voltage connector comprising:

an electrically conductive, annular connector means for providing an electrical connection between a circular, inside wall of a hollow segment of a developer roller and a stationary printer contact;

said connector means including a first side surface for providing an electrical contact with a stop extending radially inwardly from the circular inside wall of the developer roller;

said connector means including a second side surface for providing a electrical contact with the stationary printer contact; and said connector means including a circular, smooth outer peripheral surface for providing a continuous electrical contact with the circular inside wall of the developer roller.

24. A bias voltage connector as set forth in claim 23 wherein said outer peripheral surface includes a plurality of holes spaced thereabout each hole including a spring disposed therein and extending outwardly therefrom into contact with the inside wall of the developer roller.

25. A bias voltage connector as set forth in claim 23 wherein said annular connector means is coated with a resistive material having a resistance greater than said annular connector means.

26. A bias voltage connector as set forth in claim 23 wherein said annular connector means is coated with a conductive grease to improve the electrical connection between said bias voltage connector, the stationary printer contact, and the inside wall of the developer roller.

27. A method for providing an electrical connection between a developer roller and a stationary printer contact, said method including the steps of:

inserting an electrically conductive, annular bias voltage connector into a hollow segment of the developer roller to position a circular, smooth outer peripheral surface of the bias voltage connector in electrical contact with a circular, inside wall of the hollow segment of the developer roller;

positioning a first side surface of the bias voltage connector into contact with a stop extending radially inwardly from the inside wall of the developer roller; and positioning a second side surface of the bias voltage connector into contact with the stationary printer contact.

28. The method as set forth in claim 27 including coating the bias voltage connector with a resistive material having a resistance greater than the bias voltage connector prior to said step of inserting the bias voltage connector into the hollow segment of the developer roller.

29. The method as set forth in claim 27 including coating the bias voltage connector with a conductive grease prior to said step of inserting the bias voltage connector into the hollow segment of the developer roller.

* * * * *